United States Patent [19]

Farler

[11] Patent Number: 4,842,285

[45] Date of Patent: Jun. 27, 1989

[54] ANTI-BOUNCE-OUT DART

[76] Inventor: Charles W. Farler, 4503 Woodbine Ave., Dayton, Ohio 45420

[21] Appl. No.: 53,476

[22] Filed: May 26, 1987

Related U.S. Application Data

[63] Continuation-in-part of Ser. No. 868,621, May 29, 1986, abandoned.

[51] Int. Cl.[4] ..... A63B 65/02

[52] U.S. Cl. ..... 273/420; 273/423

[58] Field of Search ..... 273/416, 419, 420, 423; 403/165

[56] References Cited

U.S. PATENT DOCUMENTS

| | | | |
|---|---|---|---|
| 434,262 | 8/1890 | Freeman | 403/165 X |
| 4,181,303 | 1/1980 | Sjogren | 273/423 X |
| 4,596,393 | 6/1986 | Orav | 273/420 |

FOREIGN PATENT DOCUMENTS

| | | | |
|---|---|---|---|
| 835070 | 9/1938 | France | 273/416 |
| 445590 | 4/1936 | United Kingdom | 273/423 |
| 498823 | 1/1939 | United Kingdom | 273/423 |
| 1370092 | 10/1974 | United Kingdom | 403/165 |
| 1508075 | 4/1978 | United Kingdom | 273/423 |
| 2064967 | 6/1981 | United Kingdom | 273/423 |
| 1593047 | 7/1981 | United Kingdom | 273/420 |

*Primary Examiner*—Paul E. Shapiro

*Attorney, Agent, or Firm*—Joseph Patrick Burke

[57] ABSTRACT

An anti-bounce-out dart having a combination of features which reduce significantly the instances of a dart failing to stick in the dart board, particularly due to striking a wire on the dart board. This combination of features for the anti-bounce-out dart of this invention provides it with a unique dual action of rotating the needle off the dart wire and forcing it into the dart board holding surface. This dual action is attributable to a dart board striking needle having an off-center point portion located in the forward portion of the needle; a grooved portion of the needle located in the rearward portion thereof; a dog point screw, pin, bolt, or equivalent member, whose lower portion seats in said needle grooved portion and a cavity in the forward portion of the dart body which receives the rearward portion of the needle and permits it to rotate. The dart of this invention is further characterized by a spring located in said cavity between the rear portion of the needle and the forward most portion of the head portion of a spring retainer which abuts the dart body at the end of said cavity with the tail portion of said spring retainer passing through the central part of the helical opening formed by said spring so as to permit recocking of said needle, via., resetting the position of said pin, dog point screw, or equivalent, in said groove upon the dart striking in the dart board.

6 Claims, 5 Drawing Sheets

32
31
30
28
29

32
31
30

32
31
30
28
26
16
11

37
37
32
31
37
36
13
30
28
11

ANTI-BOUNCE-OUT DART

This application is a continuation-in-part of U.S. Patent Application Ser. No. 868,621 entitled Anti-Bounce-Out Dart) and filed on May 29, 1986 by the present inventor, now abandoned.

The present invention is directed to an anti-bounce-out dart having a combination of features which reduces significantly the instances of a dart failing to stick in the dart board, particularly due to striking a wire on the dart board. A combination of features for the anti-bounce-out dart of this invention provides it with a unique dual action which enhances greatly the dart's sticking in the dart board upon striking a wire. This dual action is attributable to a dart board striking retractable needle having an off-center point located in the forward portion of the needle; a grooved portion of the needle located in the rearward portion thereof; a dog point screw, pin, bolt, or equivalent member, whose lower portion seats in said needle grooved portion and a cavity in the forward portion of the dart body which receives the rearward portion of the needle and permits it to rotate. The dart of this invention is further characterized by a spring located in said cavity between the rear portion of the needle and the forward most portion of the head portion of a spring retainer which abuts the dart body at the end of said cavity with he tail portion of said spring retainer passing through the central part of the helical opening formed by said spring so as to permit recocking of said needle, viz. resetting the position of said pin, dog point screw, or equivalent, in said groove when the dart needle sticks in the dart board.

The aforementioned dual action forces the needle back into the dart body in cavity (18) and rotates the off-center needle point approximately 90 degrees counter-clockwise, or clockwise, depending on the curved path of the groove, so as to move it away from the center of the wire at which time the impact of the dart barrel on the spring retainer and it on the needle shoves the needle point into the holding surface of the dart board This dual action of rotation and forcing the needle point into the dart board holding surface is what significantly reduces the occurrences of bounce-outs and fall-outs.

BACKGROUND OF THE INVENTION AND PRIOR ART

A dart board (target) is basically comprised of cork or other material intended to receive and hold the needle portion of the dart upon throwing thereof and wires arranged in various positions to determine point scoring areas on a dart board. Frequently it occurs that darts are thrown slightly off the desired target area and they contact the wire portion of the dart board. All too often this results in a bounce-out whereupon the needle of the dart is rejected by the wire in the dart board causing it to bounce off the wire and land on the floor where the dart game is being held. Another cause of dart rejection by the dart board occurs when the dart needle glances off such a wire, but lacks sufficient force to retain its penetration into the dart board cork or other needle receiving material. This is referred to as a "fall out." Bounce-outs and fall-outs score 0. Thus it is seen that even among the most skillful dart throwers, a single occurrence of a bounce-out (the term being used generically to include both bounce-outs and fall outs as previously described) can determine the winners of a match.

The wires on a dart board are approximately 0.056" to 0.062" in diameter. When said wire is viewed in cross section, it becomes evident that only the top 180 degrees of its circumference is subject to impact by dart points. A dart point striking the top dead center of said circumference has a high probability of resulting in a bounce-out. Any dart point striking said wire within an arc of 45 degrees on either side of top dead center is potentially subject to a bounce-out and the possibility of a fall-out due to loss of dart momentum as a result of striking said wire. The probability of a bounce-out decreases as the point of dart impact moves away from top dead center. The probability that a dart point, which impacts a wire more than 45 degrees from top dead center, will bounce or fall-out is very low. This observation must be tempered by noting that "top dead center" is a specific location with respect to the relationship of a wire to the dart board, whereas it is a variable location with respect to thrown darts which depends on the trajectory and attitude of said darts.

The main object of this invention is to provide a dart which reduces significantly the occurrence of all bounce-outs in the broad sense such as results from the dart needle either hitting directly on the center of a dart board wire or striking a glancing blow thereon and thereafter falling from the scoring area of the dart board.

A related objective of this invention is to provide a dart structure which minimizes bounce-outs by a dual action of causing the dart needle to retract within a cavity located in the dart body and rotate the point of the needle through an arc so that it will cause the needle point to strike the needle receiving cork or other medium of the dart board with sufficient remaining force to be embedded therein for scoring.

The problem of bounce-outs due to the needle point of the dart striking a dart board wire with either a direct or glancing strike has been present virtually ever since the game of darts was first played. The problem of bounce-out and fall-out is of so much concern to dart players that it is not surprising that there have been a wide variety of attempted solutions to this problem, some of which border on the extreme.

U.S. Pat. No. 3,976.298 issued to Hinchman discloses a dart which separates upon striking a dart board wire so as to enable the needle to remain in the board.

U.S. Pat. Nos. 1,893,787 to Schroeder, 2,119,524 issued to Ghar and 2,684,851 issued to Stokes, all disclose darts which explode so as to leave the needle in the dart board.

U.S. Pat. No. 4,101,126 issued to Kurtz, et al, discloses a game dart having a pivotally movable needle point which is mounted in the dart barrel section. The rearward portion of the dart needle is mounted within an aperture located in the forward part of the barrel section. The space between the aperture and the dart contains an elastomeric material permitting the point to flex or pivot upon striking a dart board wire. FIGS. 5 and 6 of the Kurtz, et al, patent illustrate the use of a spring attached directly to the rearward portion of the dart needle (20) to allow flexing of the dart needle point when contacting a metal rib, viz., dart board wire.

U.S. Pat. No. 4,109,915 issued to Bottelsen is directed to a breakaway dart with a body.that breaks away from the point, viz., needle point, upon impact of the dart with the dart board. The stated objective of the Bottelsen breakaway dart is to minimize the size of the embedded dart in a target so that subsequent darts can be thrown to the high score area of the prior darts. Springs are employed to separate the point from the other parts of the dart and/or to hold the point in projected position during flight and to allow telescoping upon impact.

U.S. Pat. No. 4,181,303 issued to Kent Sjogren discloses a dart comprising an elongate body portion, a bore extending axially in said body portion, and a tip, viz., needle, arranged for axial movement in said board between first and second limit positions. Sjogren's dart body consists of two main parts which must be screwed together. The tip is encircled by a spring arranged in the elongate body portion. Flights are fitted to the end of the body remote from said needle tip and means may be provided for ejecting the flights of the darts upon axial movement of needle tip to its fixed limit position. Preferably the needle tip is able to move radially into the bore between preferred limits. The advantage stated for the Sjogren dart is that the number of rebounds occurring should the dart strike a dart board wire is greatly reduced in comparison with a standard dart. It will be noted from column 4, lines 30 to 49, that when a dart constructed in accordance with the Sjogren invention hits the central zone of a dart board wire, the velocity of the dart body will be lost and the dart will not enter the board. However, when a dart constructed in accordance with the Sjogren invention strikes the dart board wire in areas adjacent to the said central zone, the dart tip may stay in the target board owing to the low loss of kinetic energy after each bounce, sufficient energy remains to enable the dart needle tip to enter the board, provided that it passes the wire, viz., moves off the dart board wire and into the target medium. Note col. 4, 11. 50–67 of Sjogren. Sjogren's dart contains no mechanism to protect spring 10 from deterioration and crushing, viz., no way to limit the throw of the spring. Sjorgen apparently did not recognize the problem of spring deterioration on repeated usage of his dart and hence failed to illustrate a dart body structure capable of solving this problem.

U.S. Pat. No. 4,230,332 issued to Walter E. Bottelsen is directed to what is described as a no bounce dart having an elongate body with a dart needle point sliding in one end of the body and a tail carried at the other end of the body. The point is normally in an extended position on impact with a target, or an obstruction adjacent the target, the momentum of the body causes the point to slide in the body to a position where the body impacts the head of the needle point and hammers the needle point into the target past an obstruction, thereby reducing the likelihood of bounce of the dart.

British Pat. No. 1.593,047 issued to Brian Brooks is directed to a dart in which the dart needle point is replaceable, and which reduces the likelihood of the dart rebounding dangerously and the risk of damaging the point of the dart. In British Pat. No. 1593047, dart point (12) has a rear stepped diameter port in the stepped bore. Spring (28) lies in the larger diameter bore portion against the front of the boss of the flight part. The spring biases the point rear port against the bore shoulder. According to page 1, right column, lines 81 to 86 of this Brooks British patent, when in use spring (28) acts as a shock absorber and allows resiliently resisted axial displacement of dart needle point (18) on impact with a dart board, and thus reduces the risk of a dart rebounding dangerously when, for example, striking a dividing wire on the board. However, Brooks provides no means for limiting the extent to which his spring is compressed so that Brooks' dart body lacks the structure to retain the spring from losing its resiliency and protect it from being crushed upon repeated usage. Moreover, the Brooks dart requires an axial two diameter bore through the total length of the dart body thereby causing the dart body diameter to be larger than would otherwise be required for any given dart body weight. The larger the dart body diameter becomes, the more it constitutes an obstruction to following darts.

British Patent Application No. GB20268778A (Derwent Publications Ltd.) applicant and inventor, Cyril Cohen, discloses a dart (2) having a needle point (6) which is so mounted that the point can move laterally in any direction with respect to the remainder (4) of the dart. The dart point (6) is mounted within dart barrel (4) and is provided with a recess (8) and a rubber bush (10). The rubber bush sits in recess (8) of dart barrel (4) and locates the dart point (6) which can pivot laterally from side to side in the bush (10) with respect to the barrel (4). Alternatively, a double coil spring (14) can be located in the recess (8) in place of the rubber bush. Published Cyril Cohen British Patent Application GB2026878A is very similar to Kurtz et al U.S. Pat. No. 4,101,126.

None of these prior art patents discloses a dart having means to cause the point of a dart needle (which strikes the center of a dart wire) to rotate forcefully off the wire center and be deflected into the target when full impact of the dart occurs.

BRIEF DESCRIPTION OF THE DRAWINGS

FIG. 29 illustrates a flight shaft with three recesses combined with a flight having one extension in the flight cavity.

FIG. 30 illustrates a flight shaft having one recess and one extension located near the shaft rearmost mating portion in combination with a flight having one extension in combination with a recess in its cavity.

In accordance with flight rotation shafts and flight rotation shaft assemblies utilized within the present invention, it should be understood that one or more extension(s) can be provided on the flight rotation shaft with correspondingly shaped recesses of the same or different number on the flight cavity, or vice versa. Furthermore, combinations of a recess(es) and an extension(s) can be used in any desired position or location on the flight rotation shaft mating portion with corresponding extension(s) and recess(es) located in mating relationship and position on the flight cavity. Note FIGS. 19–24 in this regard. Moreover this(these) extension(s) can be of any desired shape, e.g., rounded, cylindrical, v-shaped. etc., and can be beveled, champfered, squared, etc.

DETAILED DESCRIPTION OF THE INVENTION

Figures 1, 2, 3, 4, 5, 6, 7, 8, 9, 10, 11, 12, 13, 14:
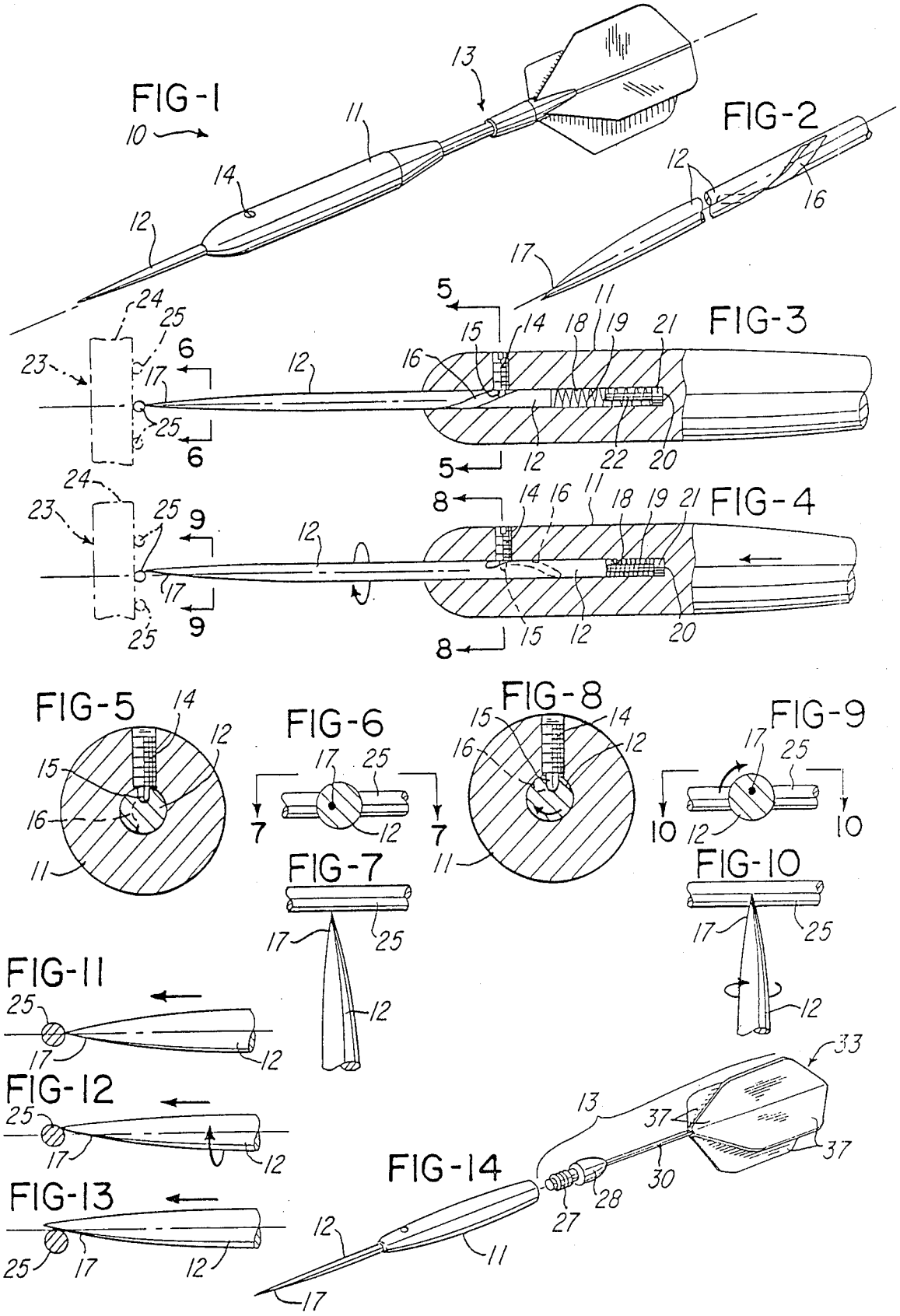
FIG. 1 is a perspective view of a dart embodying the anti-bounce-out dual action and recocking features in accordance with its invention, but having a conventional flight and flight shaft (or mounting) assembly.
FIG. 2 is a fragmentary perspective view of the needle portion of the dart body of this invention.
FIG. 3 is a fragmentary plan view with parts broken away and parts in section of the dart of this invention on a slightly larger scale than shown in FIG. 1.
FIG. 4 is a view similar to that of FIG. 3, but wherein the dart needle portion is rotated approximately 90 degrees counter-clockwise from its corresponding position shown in FIG. 3.
FIG. 5 is an enlarged cross-sectional view taken along the line 5—5 of FIG. 3.
FIG. 6 is an enlarged fragmentary cross.sectional view taken along the line 6—6 of FIG. 3.
FIG. 7 is a fragmentary plan view taken along the line 7—7 of FIG. 6.
FIG. 8 is an enlarged cross-sectional view similar to that of FIG. 5, but taken along the line 8—8 of FIG. 4.
FIG. 9 is an enlarged fragmentary cross.sectional view taken along the line 9—9 of FIG. 4.
FIG. 10 is a view similar to that of FIG. 7, but showing the off-center needle point rotating off the center of the dart board wire.
FIG. 11 is an enlarged fragmentary plan view of the needle tip portion of the needle of FIG. 3 at the point of contact with a dart board wire.
FIG. 12 is a view similar to that of FIG. 11, but illustrating the needle point rotating off the dart board wire.
FIG. 13 is a view similar to that of FIGS. 11 and 12, but illustrating the needle point rotated off the dart board wire and moving into the target board medium.
FIG. 14 is an exploded perspective view of another modification of the composite dart illustrated in FIG. 1, but having a tail assembly which is threadably removable and a flight rotation shaft in combination with a flight portion of the flight assembly, which flight portion can be fixed or rotatable at the option of the dart player.

As will be apparent from FIG. 1 of the drawings, composite (entire) dart (10) is comprised of needle (12), dart body (11), and flight assembly (13). FIG. 2 illustrates the off-center needle (12) having the off-center point (17) and the groove (slot) (16). As will be more apparent from FIGS. 3 and 4, the needle (12) is contained in needle accommodating cavity (18) located in the forward portion of the dart body (11). A dog point screw, pin, bolt, or equivalent member (14) maintains the needle (12) in position within cavity (18) due to point (15) of the dog point screw and the position it occupies seated within groove or slot (16) in conjunction with the spring (19) and its associated spring retainer (20). Spring retainer (20) is comprised of head portion (21), which abuts dart body (11) at the end of cavity (18), and tail portion (22), which passes through the center part of the helical opening formed by spring (19).

As shown in FIGS. 3 and 4, when the dart (10) is thrown at a dart board (23) composed of cork or other dart receiving medium (24) on which solid round wires (25) are placed to determine point scoring areas on the dart board, it sometimes happens that the point of the needle strikes one of the dart board wires (25) (FIG. 3). When this occurs, spring (19) is in the extended position and dog point screw (14) maintains needle (12) in a rotatable position in slot (16). Groove (16) is cut or otherwise formed at an angle of about 60 degrees to 80 degrees, and more usually at an angle of about 75 degrees, with respect to the central axis of the dart body (11). This is in conjunction with the formation of the needle point (17) to be off center by bending it or otherwise forming it anywhere from about 0.010 inch to about 0.025 inch, e.g., usually about 0.015 inch, off center in relation to the central axis of the remaining straight portion (viz., the unbent portion) of needle (12).

The grooving of groove (16) at an angle of approximately 75 degrees in combination with the aforementioned offset of point (17) of needle (12) forces the needle point to rotate approximately 90 degrees counter-clock-wise or clockwise, depending upon the manner in which groove (16) is cut with respect to the central axis of the dart body, off the center of dart board wire (25) prior to impact between the back end of said needle (12) and tail portion of spring retainer (22) forcing point (17) to embed itself in the cork or other dart board material thereby allowing a positive score in the vast majority of cases.

Once the needle point (17) has been embedded in the dart board, the pressure of spring (19) on the forward portion of head portion (21) of the spring retainer (20), FIG. 4, recocks the needle, viz., moves the needle back into its pre-striking position and resets dog point screw (14) by moving its head portion (15) back to the position shown in FIG. 3. The compressed position whereupon needle point (17) has rotated off the center of dart board wire (25) is shown in FIG. 4. The off-center aspect of needle point (17) is further illustrated in FIGS. 6, 7 and 9 through 14. The movement of rounded point (15) of dog point screw (14) within slot (16) is illustrated in detail in FIGS. 5 and 8.

The amount by which needle point (17) is forced to move upon striking a wire (25) is governed by the number of degrees through which the needle (12) is rotated in combination with the amount by which the needle point (17) is formed to be off center. E.g., a needle (12) which rotates 45 degrees and which has a needle point (17) off center 0.025" will be moved approximately 0.0125" from point of initial contact. A needle (12) which rotates 90 degrees and has a needle point (17) off center 0.0125" will also move 0.0125" from point of initial contact. In accordance with this invention, it is apparent that a number of different combinations from merely rotating the needle point (17) in place to rotating the needle point (17) through a wide and long arc would all contribute to reducing "bounce-outs" and "fall-outs." The relationship between the point at which needle point (17) makes initial contact with a wire (25) and the direction of rotation through which said point (17) will move with respect to said wire (25) will be governed by laws of probability. Needle point (17) striking a wire (25) on either side of top dead center will force the axial center of dart (12) further away from said wire (25) even though the rotation of point (17) is toward the top center of said wire (25). Spring (19) tension and forward momentum of dart body (11) and needle (12) prevents the off-center needle point (17) from climbing up a wire (25) to top dead center.

Figure 15:
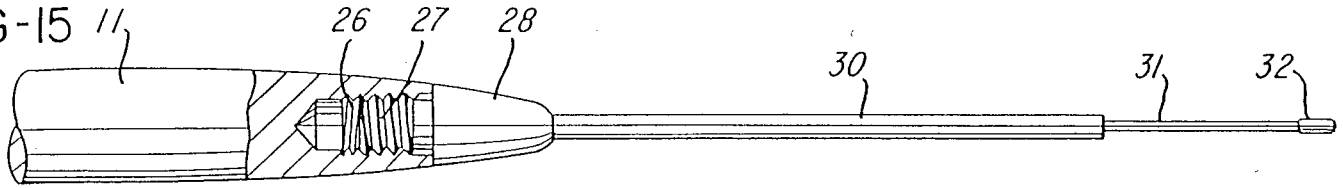
FIG. 15 is a fragmentary cross.sectional view showing the interior position of the threaded means of attaching the flight shaft to the dart body, but without the flight portion.
Figure 16:
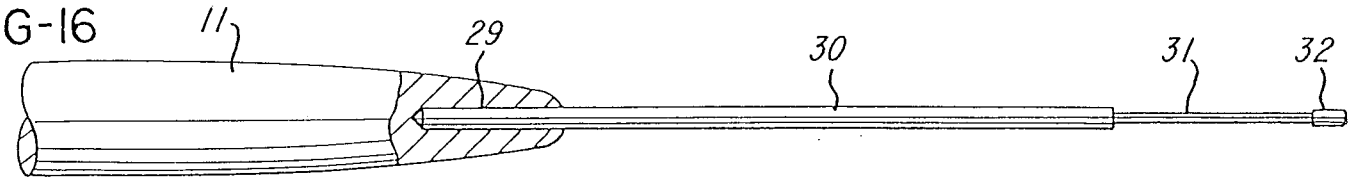
FIG. 16 is a fragmentary cross.sectional view similar to FIG. 15, but wherein the flight shaft is longer than that of FIG. 15, and does not have a threadable means of attachment to the rear of the dart body, but instead is secured through a bore located in the rear of the dart body.

In accordance with a preferred embodiment of the present invention, a dart is provided having the aforementioned double action and recocking features and additionally having a removable threaded or unthreaded flight rotation shaft assembly as illustrated in FIGS. 14, 15, 16 and 17. FIGS. 14 and 15 illustrate a threaded removable flight rotation shaft assembly having a narrow male threaded front portion (27) which is threaded into the female threaded cavity portion (26) at the rear portion of dart body (11). The portion (28) of front portion (27) which is destined to remain outside of female cavity (26) is of sleek elongated dome exterior configuration as shown in FIGS. 14 and 15. Dome portion (28), when joined to the rear of dart body (11) as shown in FIG. 15, then assumes its role as the rear end of said dart body. Attached thereto and fixed within the central portion of (28) is a small diameter substantially uniform diameter cylindrical flight shaft forward portion (30) having integral intermediate smaller diameter portion (31) and a rear extension portion (32) whose diameter can be larger than said intermediate portion (31) and either smaller than or the same diameter as said forward portion (30). On this flight shaft is positioned a rotatable or fixed flight (33) completing the flight rotation-shaft assembly (13). Of course it is also within the purview of this invention to have the male threads located on a threaded extension at the end of dart body (11) with the female threaded cavity portion located within sleek dome-shaped portion (28) for mating engagement. It will be observed from FIGS. 16, 19 and 20 that alternatively an unthreaded flight rotation shaft forward portion (30) can be inserted into an axial bore (29) at the rear portion of dart body (11) and secured by pressure fit, with a suitable adhesive (not shown) or equivalent means.

Figure 18:
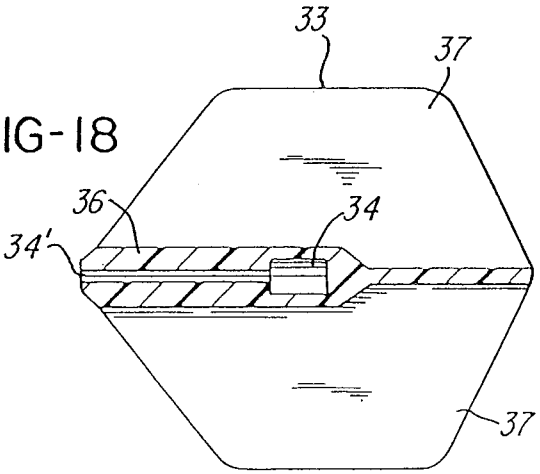
FIG. 18 is a fragmentary cross.sectional view similar to that of FIG. 17, but of the flight only and wherein the interior axial bore (cavity) of the flight is formed, e.g. around an arbor or mandrel, so as to avoid the use of a flight axial bore tube shown in FIG. 17.
Figure 17:
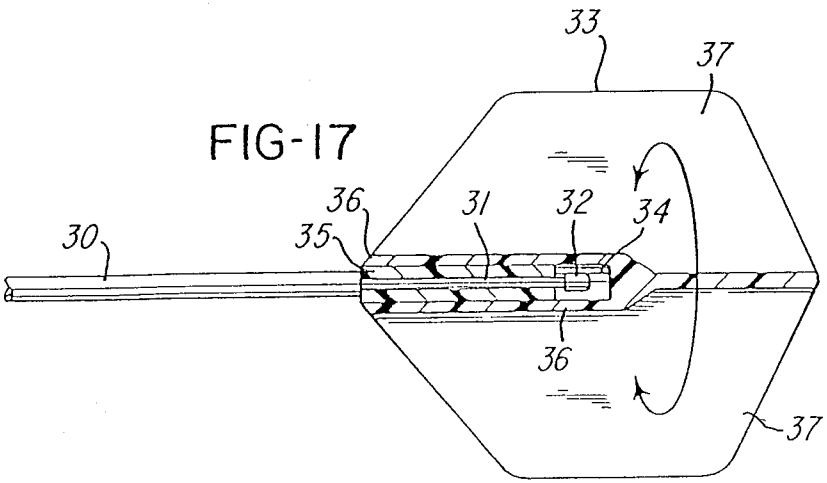
FIG. 17 is a fragmentary cross.sectional view illustrating a portion of the flight assembly of FIG. 14 wherein the flight rotation shaft and flight are in a position permitting rotation of the flight portion 360 degrees in either direction, e.g., upon being struck by a later thrown (following) dart.

The dart can be provided with a rotatable flight (33), FIGS. 17 and 18, having a plurality of, usually four, vanes or fins (37) equally spaced around its flight bushing tube (36). According to a preferred embodiment, said vanes or fins are integral with said flight bushing tube. This ability to rotate 360 degrees reduces the chances that a following dart will be deflected by striking the flight of a dart already positioned in the dart board target area. Such rotatable flight (33) has a cavity (34) along its flight central axis which cavity may extend partially or totally through said flight (see FIGS. 17, 18, 23 and 24). The cavity (34) can be formed by molding, laminating or extruding the flight around a suitable mandrel or arbor (not shown). See FIGS. 18 and 24. Alternatively it can be formed by providing a flight having a central bore cavity (34) whose forward portion is occupied by a flight axial bore tube (35) around the axis of said flight. The diameter of the cavity within tube (35) is slightly smaller than the diameter of the front portion (30) of the cylindrical flight shaft, but larger than the diameter of shaft intermediate portion (31). The rear extension portion (32) of the flight rotation shaft is formed to have a smaller diameter than said flight shaft front portion (30) and the rear portion of the cavity (34). Cavity portion (34) has a larger diameter than narrower cavity portion (34') and accommodates hub (32) whereas (34') accommodates intermediate shaft portion (31). The dimensions of the cavity wider rear portion (34) in the flight (33) and the flight rotation shaft intermediate portion (31) and hub portion (32) are such that the hub portion of the flight shaft can, with light pressure, be pressed into the cavity in the flight (33) where it "snaps" in place. When the flight (33) is installed on said flight shaft in this manner, the flight is free to rotate 360 degrees around the flight shaft intermediate portion (31) and hub portion (32). This arrangement produces a "snap-on" dart flight assembly. The flight rotation shaft assembly (13) preferably used in accordance with this invention is comprised of the foregoing flight rotation shaft (30) on which flight (33) is mounted (FIGS. 23 and 25–30) Flight (37) can be comprised of a flight bushing tube (36) located along the central axis of the flight, a plurality of vanes or fins (37) equally spaced around said flight bushing tube (36) and an axial cavity which can have a smaller inner diameter forward extension portion (34') communicating with a larger inner diameter rear recess portion (34), such axial cavity providing a gap or space between the inner surfaces of said cavity forward and rear portions so that upon insertion of said flight rotation shaft extension portion (32) through said front cavity extension portion (34') and into said rear cavity recess portion (34), said flight (33) is free to rotate 360 degrees, clockwise or counter-clockwise, around said flight rotation shaft.

Figure 23:
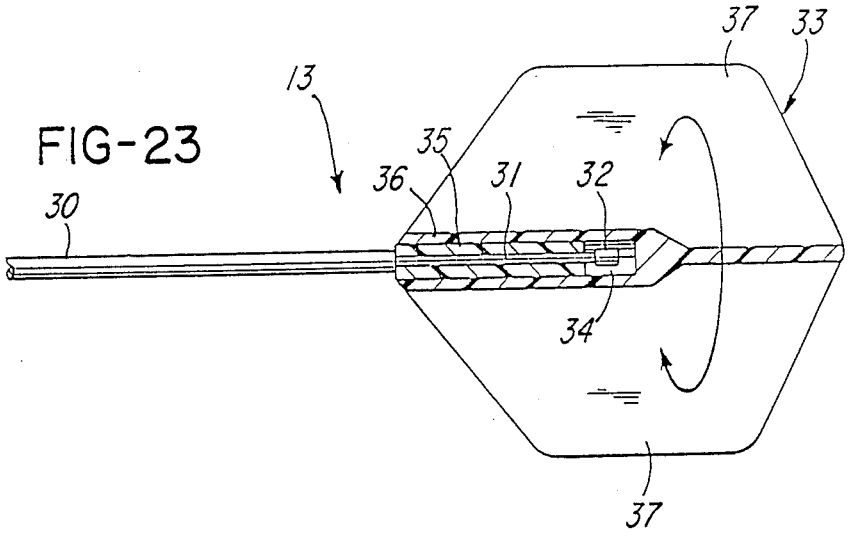
FIG. 23 is a fragmentary cross.sectional view of the flight rotation shaft assembly with the flight rotation shaft and flight in position to rotate in either direction, e.g., upon being struck by a later thrown (following) dart.
Figure 24:
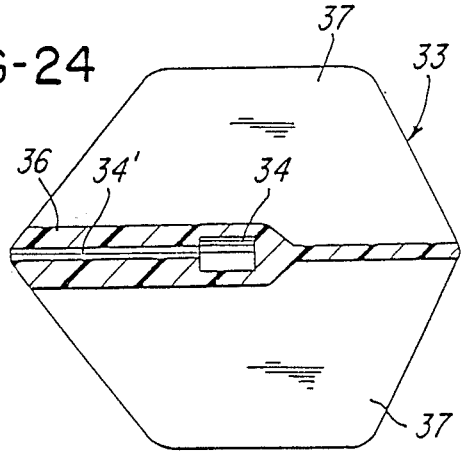
FIG. 24 is a cross-sectional view of a flight only wherein the interior axial bore (cavity) of the flight is formed, e.g., around an arbor or mandrel, so as to avoid the use of a flight axial bore tube shown in FIG. 23.
Figure 25:
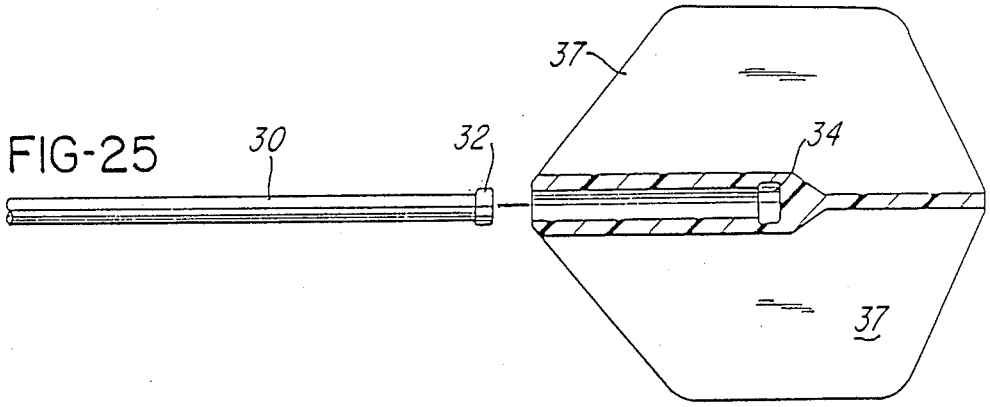
FIG. 25 is a fragmentary composite side and cross-sectional view of one embodiment illustrating a flight rotation shaft and flight prior to coupling (mating) having one cylindrical extension on the shaft with one correspondingly shaped recess in the cavity of the corresponding flight.
Figure 26:
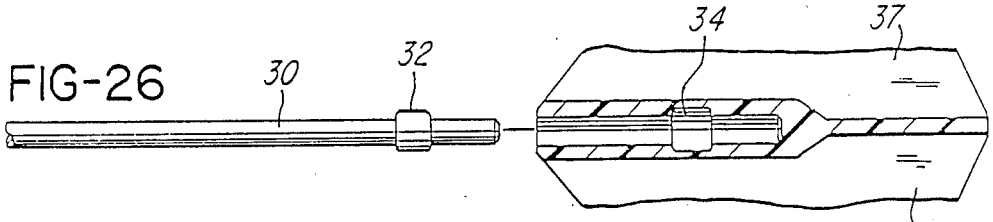
FIG. 26 is a fragmentary composite side and cross-sectional view of another embodiment of this invention similar to that of FIG. 25 and illustrating a single extension on the flight rotation shaft which is wider than that shown in FIG. 25 with a corresponding recess in its flight.
Figure 27:
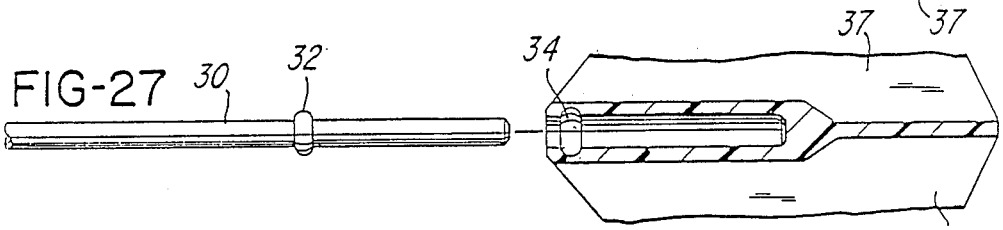
FIG. 27 is a view similar to those of FIGS. 25 and 26 but wherein the flight rotation shaft is provided with one, or more, substantially rounded extension(s) with the flight cavity having a corresponding number of rounded recess(s). It will be observed that the number of recesses must be equal to or greater than the number of extensions.
Figure 28:
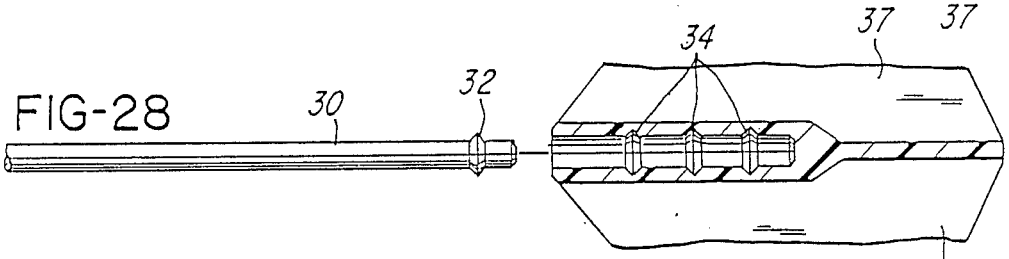
FIG. 28 is a view similar to those of FIGS. 25–27 but wherein the flight shaft extension or raised surface is substantially v-shaped to accommodate one or more correspondingly shaped recesses of the flight cavity. This combination allows the shaft extension to mate in any one of three positions within the three recesses of the flight cavity and allows the overall length of the dart to be varied at will.
Figure 29:
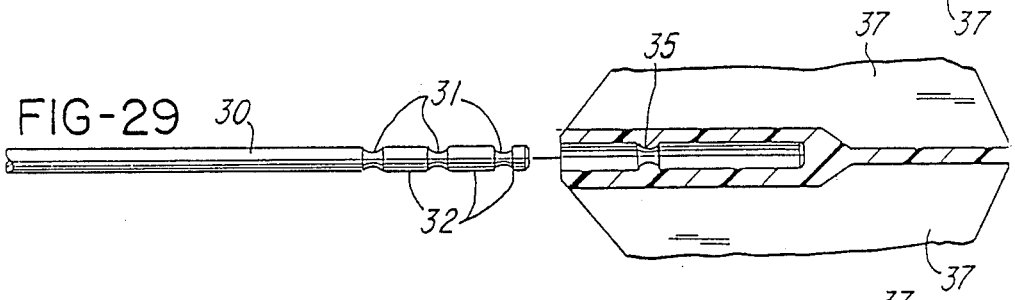
FIGS. 29–30 are views similar to FIGS. 25–28 but illustrate shaft-flight combinations wherein the recesses are in the flight rotation shaft and the extensions (raised portions) are provided in the flight cavity.
Figure 30:
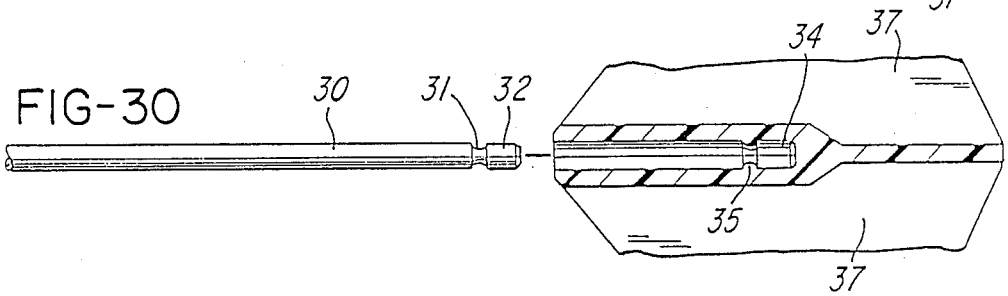

As shown in FIG. 23, flight axial bore tube (35) can be inserted into flight bushing tube (36) so that the internal surface of said bore tube defines the forward flight cavity axial portion (34').

It will also be noted that by applying force the forward portion (30) of said flight shaft can be inserted into the narrower (smaller diameter) cavity portion (34') so that a small rear section of the front portion (30) of said flight shaft is pressed into the narrower cavity front portion (34') in flight bushing tube (36). Such action will produce friction between the rear of flight shaft forward portion (30) and the narrower cavity portion (34') thereby preventing flight rotation. It is expected that few dart players will elect to use the flight assembly (13) with the flight (33) installed in a "fixed" configuration.

While the discussion above has centered around rotation of the dart needle point through an angle of approximately 90 degrees to permit it to rotate off a dart board wire, it is within the purview of this invention to cut, or otherwise form, the groove and bend, or otherwise form, the needle point in such a way as to permit the needle point (17) to rotate through an arc which can range from about 45 degrees to about 90 degrees with relation to the central axis of the dart body.

It is also within the purview of this invention for groove (16) to be truncated by forming it by forging or other means so that the slot would be closed as compared with being open at both ends as shown in the present drawings.

The bounce-out resistant dart of this invention can have a conventional flight body (assembly) as shown in FIG. 1 or the improved flight rotation shaft assembly referred to herein above as shown in FIGS. 14 through 30. The dart of this invention has been tested on a test device containing dart board wires spaced far closer together than actually encountered in dart boards used in dart throwing competition games. The test device was comprised of a standard dart board from which all wires were removed. A total of 91 new stainless steel, 0.056" diameter, wires were installed on the dart board such that they extended across the entire dart board target area. The wires were installed in a parallel configuration with a space of approximately 0.097" between the edges of said wires. Most dart needles have a diameter of 0.092" to 0.0935". A round mask was made from formica and installed with an axle at the center of the dart board. One quarter of the mask was cut-away thereby exposing one quarter of the wires on the dart board. The entire dart board assembly was rotated to place the exposed wires in a vertical position. 200 darts were thrown at the exposed section of the dart board and data as to "bounce-outs" experienced was recorded. The entire dart board assembly was then rotated 30 degrees clockwise and the experiment repeated. This procedure was repeated until the dart board and mask had been rotated 360 degrees in 30 degree increments with the result that 2,400 darts of a specific type were thrown at a specific section of wires. At this point the mask was rotated 90 degrees on the dart board thereby exposing a new section of wires. Each type of dart thrown was thrown at a new section of wires. Each wire in each section was held in place with two staples made from 0.056" diameter wire. Tests were conducted on the above test device in the above mentioned manner using standard darts, viz., darts having a needle in fixed position which do not retract and do not rotate, darts wherein the needle is capable of retracting in a substantially straight back manner without any significant turning or rotation, viz., in the manner of Bottelsen U.S. Pat. No. 4,230,332 and the darts of this invention, as illustrated in FIGS. 1 through 15 of the drawings. Table A illustrates the results obtained with fixed needle standard (conventional) darts. Table B illustrates the results obtained with substantially straight back retracting needle darts, e.g., as shown by Bottelsen U.S. Pat. No. 4,230,332. Table C illustrates the results obtained using the darts of this invention.

TABLE A

| Wire Position (Degrees) | No. of Bounce-Outs | % of Bounce-Outs |
|---|---|---|
| 360 | 2 | 1 |
| 30 | 8 | 4 |
| 60 | 10 | 5 |
| 90 | 7 | 3.5 |
| 120 | 4 | 2 |
| 150 | 1 | .5 |
| 180 | 5 | 2.5 |
| 210 | 3 | 1.5 |
| 240 | 5 | 2.5 |
| 270 | 4 | 2 |
| 300 | 6 | 3 |
| 330 | 9 | 4.5 |
| TOTALS - 2,400 darts | 64 | 2.66 |

This accounts for an average of one bounce-out per every 37.5 darts thrown. The maximum number of throws with no bounce-outs was 150.

TABLE B

| Wire Position (Degrees) | No. of Bounce-Outs | % of Bounce-Outs |
|---|---|---|
| 360 | 2 | 1.0 |
| 30 | 1 | 0.5 |
| 60 | 2 | 1.0 |
| 90 | 1 | 0.5 |
| 120 | 0 | 0.0 |
| 150 | 0 | 0.0 |
| 180 | 0 | 0.0 |
| 210 | 1 | 0.5 |
| 240 | 1 | 0.5 |
| 270 | 0 | 0.0 |
| 300 | 0 | 0.0 |
| 330 | 0 | 0.0 |
| TOTALS - 2,400 darts | 8 | .003 |

This represents an average of one bounce-out per every 300 darts thrown. The maximum number of throws with no bounce-out using the commercialy available substantially straight back type retracting needle darts was 750.

TABLE C

| Wire Position (Degrees) | No. of Bounce-Outs | % of Bounce-Outs |
|---|---|---|
| 360 | 1 | 0.5 |
| 30 | 0 | 0.0 |
| 60 | 0 | 0.0 |
| 90 | 0 | 0.0 |
| 120 | 0 | 0.0 |
| 150 | 0 | 0.0 |
| 180 | 0 | 0.0 |
| 210 | 1 | 0.5 |
| 240 | 0 | 0.0 |

TABLE C-continued

| Wire Position (Degrees) | No. of Bounce-Outs | % of Bounce-Outs |
|---|---|---|
| 270 | 0 | 0.0 |
| 300 | 0 | 0.0 |
| 330 | 1 | 0.5 |
| TOTALS - 2,400 darts | 3 | .00125 |

This represents an average of one bounce-out for every 800 darts thrown. The maximum number of throws with no bounce-out using the darts of this invention was 1,380.

In each of the test results of Table A, B and C, the term "bounce-out" indicates the dart was rejected by a wire on the dart board.

It will be observed that the foregoing test results were conducted on a test device containing a far greater percent of solid stainless steel wires than is customarily present in competition dart boards of the approved variety. The benefits obtained and the results securable with the double action dart of the present invention can be readily appreciated. Thus it has been determined that the dart of this invention provides superior anti-bounce-out characteristics compared to fixed needle darts and darts having a substantially straight back retracting needle.

Figures 19, 20, 21, 22:
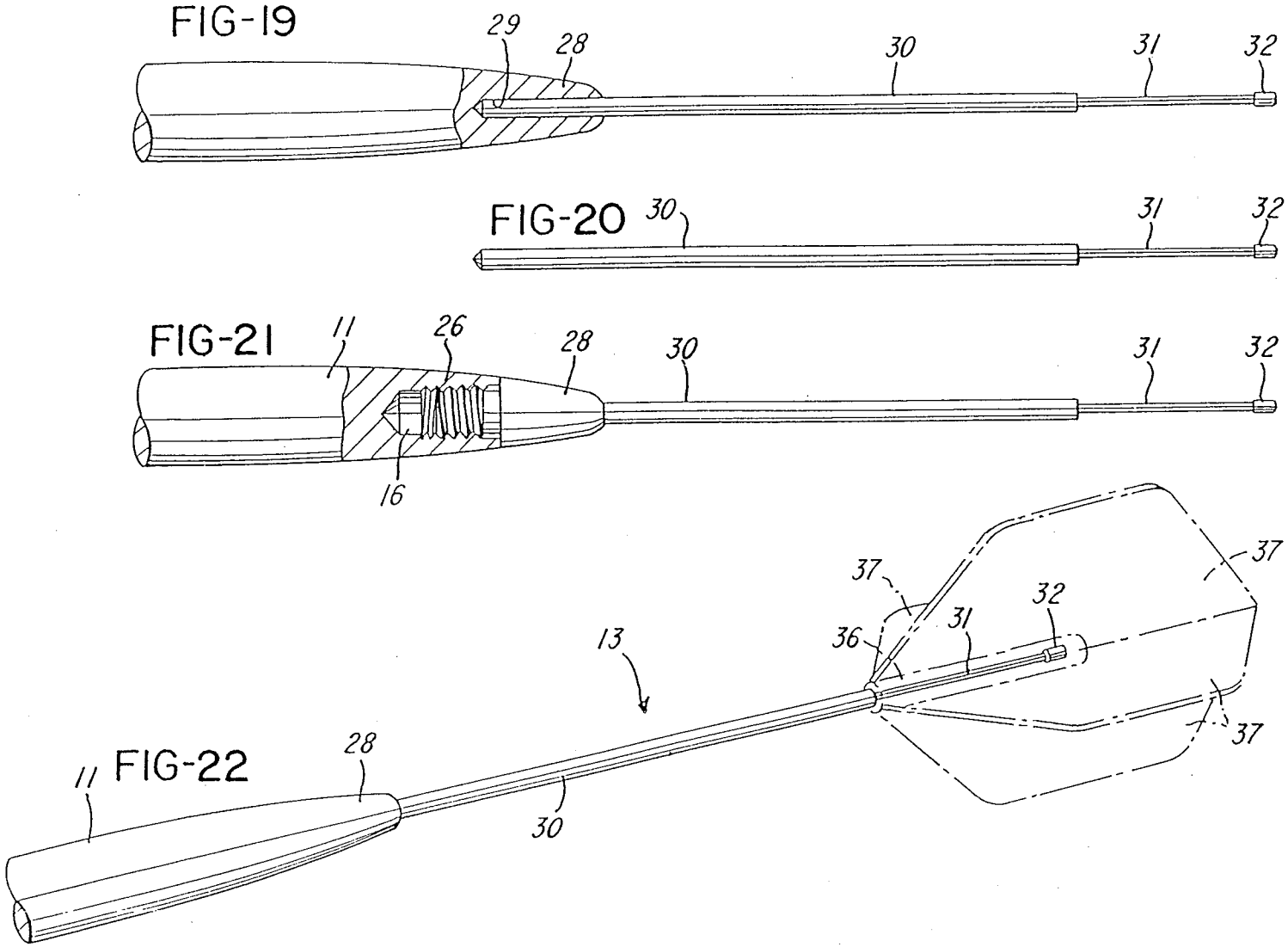
FIG. 19 is a fragmentary plan view with parts broken away and parts in section of one embodiment of a flight rotation shaft secured in place in a dart body.
FIG. 20 is a plan view of the flight rotation shaft of FIG. 19 apart from its environment of use.
FIG. 21 is a modification of the flight rotation shaft shown in FIG. 19 which provides a threaded front portion for attachment to a dart body rearward portion having mating threads.
FIG. 22 is a fragmentary perspective view of the flight rotation shaft assembly containing a flight rotation shaft as in FIGS. 19 or 21 with a snap-on flight (shown in phantom lines) mounted thereon.

The flight shaft, comprised of forward portion (30). optional intermediate portion (31) and hub portion (32), as illustrated in FIGS. 16, 17, 19, 20, 22, 23 and 25 through 30, as such, or alternatively including a threaded forward portion (28) having a male threaded member (27), as illustrated in FIGS. 14, 15 and 21, is disclosed and claimed in my co-pending patent application Ser. No. 918,719 entitled "Dart Flight Rotation Shaft and Flight Rotation Shaft Assembly" filed on Oct. 14, 1986. Ser. No. 918,719 additionally discloses and claims flight rotation shaft assembly (13), e.g., as in FIGS. 14, 22, 23 and 25–30, having either the threaded structure of FIGS. 14 and 15 or the unthreaded structure of FIGS. 16, 17, 19, 20, 22, 23 and 25–30, in combination with flight (33). Such flight rotation shaft assemblies are suitable for use in retrofitting to conventional dart bodies, and as constituting the preferable flight rotation shaft assemblies in accordance with the darts of this invention. The entire disclosure of my co-pending patent application Ser. No. 918,719 is incorporated herein by reference as if fully repeated herein. Ser. No. 918, 719 is a continuation in part of my earlier filed U.S. patent application Ser. No. 868,622 filed on May 29, 1986 also entitled "Dart Flight Rotation Shaft and Flight Rotation Shaft Assembly". The disclosure of Ser. No. 868,622 is likewise incorporated herein by reference.

The flight rotation shaft and flight rotation shaft assembly preferably utilized with this invention are characterized in that no portion of the flight rotation shaft means (32) of attaching the flight thereto is external to any external surface of the flight. This flight rotation shaft assembly is also characterized by having an axial flight cavity whose inner diameter has one or more respective extension(s) and/or recess(es) whose distances and shape conform substantially to, yet leave a gap or space between, those respective extension(s) and/or recess(es) on the mating portion of said flight rotation shaft to cause a slip fit union therewith permitting said flight to rotate freely around said shaft.

The forward portion (30) of the flight rotation shaft assembly is of substantially uniform diameter except that it may include a threaded front portion of sleek elongated dome exterior configuration suitable for threaded engagement with the mating threaded rearward portion of a dart body.

The diameters of the hub extension(s), and remaining mating portion(s) of the flight rotation shaft are such that the flight is free to rotate around said assembly or be fixed thereon, depending on the positioning of the flight rotation shaft extension(s) and/or recess(es) in relation to the corresponding recess(es) or extension(s) of the axial cavity portion(s) of the flight.

The flight rotation shaft assembly discussed herein is further characterized in that it eliminates the requirement, common to prior art shaft assemblies for replaceable flights, or having flight attachment means external to the outer surfaces of the flight.

The snap-on dart flights (33), illustrated in FIGS. 14, 17, 18, and 22–30, whose use is preferred with the dual action, recocking dart of this invention, are, per se, disclosed and claimed in my co-pending application Ser. No. 918,720 entitled "Snap-On Dart Flight" filed on Oct. 14, 1986. The entire disclosure of said patent application Ser. No. 918,720 is incorporated herein by reference as if fully repeated herein. Ser. No. 918,720 is a continuation-in-part of my earlier filed U.S. patent application Ser. No. 868,804 filed on May 19, 1986 also entitled "Snap-On Dart Flight." The disclosure of Ser. No. 868,804 is likewise incorporated herein by reference.

I claim:

1. An anti-bounce-out dart comprising a retractable needle having an off center point located in the forward portion of the needle wherein said off center needle point is from about 0.010 inch to about 0.025 inch off center in relation to the central axis of the remaining straight portion of said needle; a grooved portion formed at an angle of about 60 degrees to about 80 degrees with respect to the central axis of the dart body located in the rearward portion of the needle; a seated member being a dog point screw, pin, bolt or equivalent whoose lower portion rests or seats in said needle grooved portion; a dart body; a cavity in the forward portion of the dart body which receives the rearward portion of the needle and permits it to rotate, a spring located in said cavity between the rear portion of the needle and the forward most portion of the head portion of a spring retainer which abuts the dart body at the end of said cavity with the tail portion of said spring retainer passing through the central part of a helical opening formed by said spring thereby permitting resetting the position of said seated member in said needle groove and repositioning said needle when the dart needle sticks in a dart board; and a flight assembly, said dart having a dual action of rotation of said needle and forcing said needle point off a dart board wire, upon striking same, and forcing same into the dart board holding material.

2. An anti-bounce-out dart as in claim 1 wherein said needle groove is formed at an angle of about 75 degrees with respect to the central axis of said dart body.

3. An anti-bounce-out dart as in claim 1 wherein said off-center needle point is about 0.015 inch off-center in relation to the central axis of the remaining straight portion of said needle.

4. An anti-bounce-out dart as in claim 1 wherein said needle groove is formed at an angle of about 75 degrees with respect to the central axis of said dart body and said off-center needle point is about 0.015 inch off-center in relation to the central axis of the remaining straight portion of said needle.

5. An anti-bounce-out dart comprising a retractable needle having an off-center point which is from about 0.010 inch to about 0.025 inch off-center in relation to the central axis of the remaining straight portion of said needle located in the forward portion of the needle; a grooved portion located in the rearward portion of the needle wherein said needle groove is formed at an angle of about 60 degrees to about 80 degrees with respect to the central axis of said dart body and said off-center needle point; a seated member whose lower portion seats in said needle grooved portion; a dart body; a cavity in the forward portion of the dart body which receives the rearward portion of the needle and permits it to rotate, a spring located in said cavity between the rear portion of the needle and the forward most portion of the head portion of a spring retainer which about the dart body at the end of said cavity with the tail portion of said spring retainer passing through the central part of a helical opening formed by said spring thereby permitting resetting the position of said seated member in said needle groove and repositioning said needle when the dart needle sticks in a dart board, and a flight assembly comprised of an integral flight rotation shaft having a cylindrical forward portion and a flight mating portion, wherein said flight mating portion has either one or more extension(s) and/or recess(es) than its remaining portion(s) to enable it to mate at such portion(s) in a slip fit with one or more respective recess(es) or extension(s) in the axial cavity portion(s) of a dart flight having mounted thereon a snap-on, rotatable fliqht such that no portion of the means of flight attachment is external to any external surface of said flight and wherein said flight is comprised of a flight bushing tube having a plurality of vanes or fins equally spaced around said flight bushing tube and an axial flight cavity whose inner diameter has one or more respective extension(s) and/or recess(es) whose distances and shape conform substantially to, yet leave a gap or space between, those respective extension(s) and/or recess(es) on the mating portion of said flight rotation shaft to cause a slip fit union therewith permitting said flight to rotate freely around said shaft, said dart having a dual action of rotation of said needle and forcing said needle point off a dart board wire, upon striking same, and forcing same into the dart board holding material.

6. An anti-bounce-out dart as in claim 5 wherein said needle groove is formed at an angle of about 75 degrees with respect to said central axis of said dart body and said off-center needle point is about 0.015 inch off-center in relation to said central axis of the remaining straight portion of said needle.

* * * * *